United States Patent [19]

Haul

[11] Patent Number: 4,843,830

[45] Date of Patent: Jul. 4, 1989

[54] DIFFERENTIAL ICE SENSOR AND METHOD

[75] Inventor: Robert W. Haul, St. Louis, Mo.

[73] Assignee: Emerson Electric Co., St. Louis, Mo.

[21] Appl. No.: 255,518

[22] Filed: Oct. 11, 1988

[51] Int. Cl.[4] ..... F25C 1/00

[52] U.S. Cl. ..... 62/59; 62/139; 73/304 R; 340/580

[58] Field of Search ..... 62/59, 139; 137/392; 73/304 R; 340/580

[56] References Cited

U.S. PATENT DOCUMENTS

| | | | |
|---|---|---|---|
| 2,506,775 | 5/1950 | Calabrese | 62/141 |
| 3,056,273 | 10/1962 | Cornelius | 62/393 |
| 3,252,420 | 5/1966 | Sorensen | 103/25 |
| 3,279,379 | 10/1966 | Klyce | 137/392 X |
| 3,484,805 | 12/1969 | Lorenz | 137/392 X |
| 3,496,733 | 2/1970 | Parker et al. | 62/139 |
| 3,502,899 | 3/1970 | Jones | 307/118 |
| 4,480,441 | 11/1984 | Schulze-Berge et al. | 62/138 |
| 4,497,179 | 2/1985 | Iwans | 62/59 |
| 4,754,609 | 7/1988 | Black | 62/59 |

OTHER PUBLICATIONS

Cornelius Ice Bank Control Operational Manual 12/1978.

Wiring Diagram and Instruction Sheet as shown in U.S. Pat. No. 4,480,441.

*Primary Examiner*—William E. Wayner

*Attorney, Agent, or Firm*—Polster, Polster and Lucchesi

[57] ABSTRACT

A differential ice sensing system and method for a cold drink beverage dispenser or the like is disclosed. The beverage dispenser has an ice bath cooling tank containing a supply of water. A refrigerated cooling surface is provided within the tank so as to freeze a portion of the water into a body of ice. The beverage dispenser has a beverage flow path which is cooled by the liquid in the ice bath. The differential ice sensing system comprises a first conductivity (or impedance) probe which is disposed in the water of the ice bath at a position where it will sense the conductivity of the ice when the body of ice formed on the refrigerated surface attains a predetermined size. A second conductivity probe is disposed within the liquid so that it is maintained in conductivity sensing relationship with the liquid. Each of the probes is responsive to an electric current supplied thereto to measure the electrical conductivity in its vicinity. A system is provided for detecting conductivity differences between the first and second probes indicative of the presence of ice at the first probe and for generating a signal indicating presence of ice at the first probe. This signal may be utilized to block the flow of refrigerant to the refrigerated surface when the body of ice formed has reached a pre-determined size and to initiate the flow of refrigerant when the body of ice is less than a desired size.

6 Claims, 2 Drawing Sheets

DIFFERENTIAL ICE SENSOR AND METHOD

BACKGROUND OF THE INVENTION

Generally, this invention relates to an ice sensor or detector for an ice bath-type of heat exchanger, and more particularly to a so-called differential ice sensor for an ice bath-type cold drink or beverage dispenser.

Ice bath cold drink dispensers are well known. An example of such a prior art ice bank beverage despenser is shown in U.S. Pat. No. 3,056,273. Typically, such cold drink dispensers have a refrigeration system having an evaporator or other refrigerated surface immersed in a liquid water bath. The refrigeration system is operated so as to direct refrigerant through the evaporator (or refrigerated surface) thereby to freeze a quantity of ice on the refrigerated surface within the ice bath. By circulating the remaining liquid water in the ice bath around the body of ice and over the beverage flow path, the temperature of the remaining water in the ice bath can be maintained in a substantially isothermal condition at or only slightly above the freezing point. The beverage line or flow path is in direct heat transfer relation with the liquid water in the ice bath such that efficient cooling of the beverage is effected and such that the beverage may be chilled to near the freezing point, without danger of freeze-up of the beverage in the beverage flow path.

During normal usage, the heat given off by the beverage flowing through the beverage line immersed in ice bath water causes the outer surface of the ice body to melt. During normal usage rates, the refrigeration system can make up for the melting of the ice so as to maintain the ice body at a pre-determined size thereby to provide sufficient reserve cooling capacity for peak usage periods. During peak usage periods, the refrigeration system may not be able to remove the heat from the ice bath so as to maintain the body of ice at its pre-determined size. As a result, during such peak usage periods, the size of the ice body may decrease. However, because of the isothermal relationship within the ice bath, the beverage will still be chilled to at or near the freezing point. After the peak usage period has passed, the refrigeration system operates to re-freeze the water such that the ice body will again attain its pre-determined size.

In this manner, a smaller, more efficient and less costly refrigeration system may be utilized for the cold drink dispenser, and yet during peak usage periods, the cold drinks will be dispensed at a chilled temperature at or near the freezing point without chance of freeze-up.

Conventionally, such ice bath cold drink dispensers (and other similar refrigeration systems, such as milk coolers or the like) have utilized sensors to determine when the size of the ice body formed by the refrigerated surface has been frozen or "grown" to a pre-determined size or envelope. When the ice body has attained its predetermined size, the refrigeration system is shut down. As the ice begins to melt, either as the result to beginning to warm to room temperature or as a result of a beverage being chilled by the ice bath, the ice sensor again energizes the refrigeration system to begin replenishment of the ice body to its desired predetermined size.

Reference may be made to such U.S Pat. Nos. as 2,506,775, 3,252,420, 3,496,733, 3,502,899, 4,480,441 and 4,497,179 which disclose a variety of prior art ice and liquid level sensors in the same general field as the present invention.

Recently, an improved cold drink dispenser has been commercially introduced which utilizes a pre-chilling coil to pre cool the incoming beverage (i.e., city tap water to be carbonated in a post mix cold drink dispenser) prior to the beverage being fully cooled in an ice bath chiller. The pre-chilling coil and the ice bath coil are both supplied refrigerant from a common refrigeration system, as required, and as determined by an electronic control system. This two cooling coil cold drink dispenser is described in U.S. Pat. No. 4,754,609 invented by William J. Black and assigned to the Cornelius Company of Anoka, Minn. An improved control system for such a two cooling coil cold drink dispenser is disclosed in U.S. patent application Ser. No. 171,455 invented by David P. Forsythe and co-assigned to the Emerson Electric Co., the assignee of the present application.

Generally, prior art ice body sensors utilized two impedance or conductivity probes positioned in the water such that one of the probes was to sense a position of a minimum size for the ice body and the other was positioned to sense a maximum size for the ice body. However, such prior art ice sensors sensed on the absolute conductivity or impedance of the water such that if the impedance of the water changed sufficiently, as due to changes in dissolved minerals in the water or due to other contamination, false readings of the presence of ice may be detected.

SUMMARY OF THE INVENTION

Among the several objects and features of this invention may be noted the provision of a differential ice sensor and method which is relatively insensitive to impedance changes in the water due to the presence of dissolved minerals or of other contamination and which reliably senses the presence and the absence of ice.

Briefly stated, an ice sensing system is disclosed for use in a beverage dispenser or the like. The beverage or cold drink dispenser includes a cooling tank having a transfer liquid (e.g., water) therein. A refrigerating surface (e.g. a cooling coil or cold plate) is provided for cooling the liquid in the cooling tank. A beverage flow path is in heat transfer relation with the liquid in the tank so that beverage dispensed through the beverage flow path is cooled by the liquid. The liquid in the cooling tank is capable of being frozen into ice by the refrigerating surface. Specifically, the ice sensing means comprises a first conductivity probe disposed within the liquid within the cooling tank at a first pre-determined position. A second conductivity probe is also positioned within the liquid at a second pre-determined position, with the relative locations of the first and second probes with respect to the refrigerating surface being such that the first probe is disposed at a location where the liquid is to be frozen into ice by the refrigerating surface when the ice attains a pre-determined size while the second probe remains in the liquid. Additionally, means is provided for supplying electric current to the first and second probes with each of the probes being responsive to the electric current so as to measure the electrical conductivity in its vicinity, the liquid in the cooling tank being such that its conductivity as a liquid is significantly different from its conductivity as an ice. Further, means is provided for detecting conductivity differences between the first and second probes indicative of the presence of ice at the first probe and for signalling the presence of ice.

Other objects and features of this invention will be in part apparent and in part pointed hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
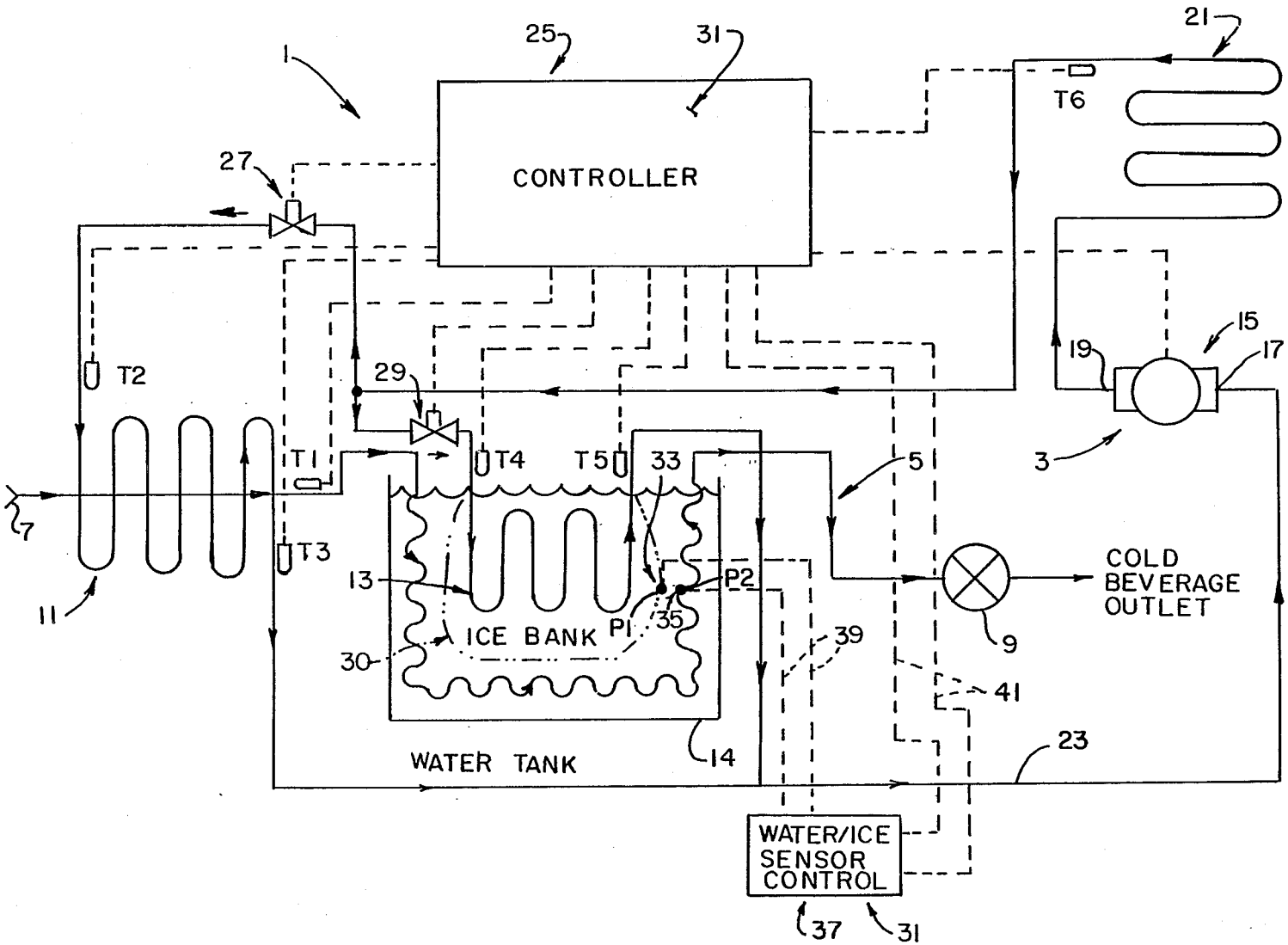
FIG. 1 is a diagramatic representation of a two cooling coil cold drink beverage dispenser utilizing a differential ice sensor of the present invention for controlling operation of a refrigeration system thereby to maintain a body of ice within the ice bath at or near a pre-determined desired size.

Referring now to the drawings, and more particularly to FIG.1, a cold drink dispenser is indicated in its entirety by reference character 1. The dispenser has a refrigeration system, as generally indicated at 3, with the later having a beverage flowpath 5 extending therethrough from a beverage inlet 7 which draws beverage from the beverage source (not shown) to a beverage dispensing valve 9. Cold drink dispenser 1 may be utilized to dispense either premix or post-mix beverages. Beverage flowpath 5 may, for example, be the flowpath of water through the cold drink dispenser after, or, more preferably, before it is carbonated by a suitable carbonator (not shown) in a manner well known to those skilled in the art. It will be understood that in the cold drink dispenser, chilled carbonated water is preferably delivered to beverage dispensing valve 9 at which point it is mixed in a predetermined ratio with the soft drink syrup to form a finished beverage product as the mixed carbonated water and syrup are dispensed into a cup or other container. However, within the broader aspects of this invention, any type of beverage, including the syrup itself or a premixed beverage may be drawn through beverage flowpath 5 and chilled by refrigeration system 3. It will also be appreciated that fluids other than beverages may be refrigerated or chilled by apparatus similar to dispenser 1.

More specifically, cold drink dispenser 1 includes a first or prechiller coil, as generally indicated at 11, and a second or an ice bank coil 13 disposed within an ice bank water bath 14. Water bath 14 has a quantity of water therein and coil 13 is at least in part immersed in the water such that water will freeze on coil 13 when refrigeration system 3 is operated. It will be noted that beverage flowpath 5 is in heat transfer relation with the first or prechiller coil 11. The second or ice bank coil 13 is located downstream (referring to beverage flowpath 5) relative to the prechiller coil and the ice bank coil is also in heat transfer relation with the beverage flowpath in that the beverage flowpath is, in part, immersed in the water bath. Preferably, a pump (not shown) is provided to circulate the water in the water bath so as to circulate the liquid water over the ice bank and over the beverage flow path. Refrigeration system 3 further comprises a suitable refrigerant compressor 15 having a refrigerant or suction inlet 17 and a refrigerant outlet 19. Refrigerant at relatively high pressure and high temperature discharged from the compressor via outlet 19 is circulated through a condenser coil 21 so as to give off heat to the surroundings. The outlet sides of the first and second coils 11 and 13, respectively, are connected by a suction line 23 to the inlet or suction side 17 or compressor 15 such that the refrigerant, after it has passed through the coils, may be returned to the compressor.

As generally indicated at 25, a refrigeration control system is incorporated within cold drink dispenser 1. Refrigeration control system 25 comprises a first modulatable valve 27 interposed between condenser 21 and the inlet side of the first or prechiller coil 11. Likewise, a second modulatable valve 29 is interposed between condenser 21 and the inlet side of the second or ice bank coil 13. Valve 27 is sometimes referred to as the prechiller coil electronic (PCE) expansion valve, and valve 29 is sometimes referred to as the ice bank electronic (IBE) expansion valve.

The above described cold drink dispenser 1 is essentially identical to the two coil cold drink dispenser more fully described and claimed in the co-signed U.S. patent application Ser. No. 171,455 filed Mar. 21, 1988 and invented by David P. Forsythe, which is herein incorporated by reference.

As noted in FIG. 1, an ice bank or body 30 typically forms on ice bank coil 13 with the outer surface of the ice body defining an ice body envelope or outer surface. The size of the ice body within the ice bath increases or decreases depending on the draw of beverage through the beverage flowpath 5 and depending on the operation of the refrigeration system so as to pass refrigerant through valve 29 and through the ice bank coil 13.

In accordance with this invention, a so-called differential ice detector or ice sensing system, as generally indicated at 31, is provided for sensing when ice body 30 has attained a predetermined size, and for controlling operation of the refrigeration system 3. In this manner when the ice bank envelope attains a maximum predetermined size, the refrigerant flow through ice bank coil 13 is terminated or blocked, and when the size that the ice bank or body decreases below a predetermined size, rfrigerant flow through the ice bank coil 13 is re-established to cause the size of the ice bank body to increase.

Further in accordance with this invention, a first conductivity (i.e., resistance or inductance) probe, as generally indicated at 33, is disposed within the liquid in the water tank at a first position P1. A second conductivity probe 35 is disposed within water within the water tank 14 at a second pre-determined position P2. These probes are commercially available from the Cornelius Company of Anoka, Minnesota. Each probe consists of a pair of spaced electrodes for measuring conductivity differences therebetween. The relative locations of the first and second probes 33 and 35 with respect to the refrigerating surfaces of ice bank coil 13 are such that the first probe 33 is disposed within water tank 14 at a location where the liquid is to be frozen into ice by the refrigerating surface of coil 13 when the ice body 30 attains a predetermined size, while the second probe is located outside the maximum envelope of the ice body so as to remain in conductivity sensing relationship with the liquid water within tank 14.

Figure 2:
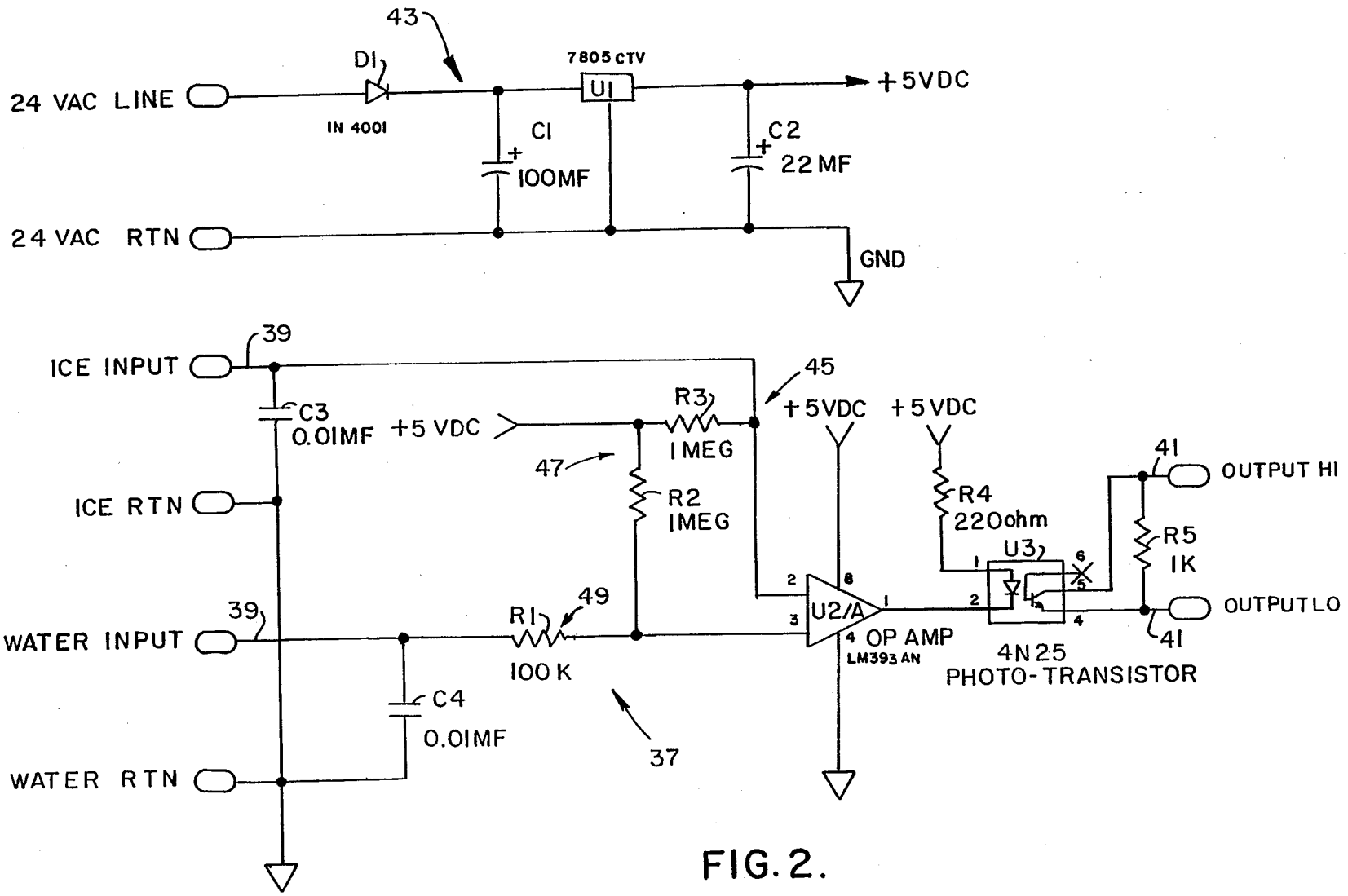
FIG. 2 is a schematic diagram of a control system for supplying electrical current to the probes of the ice sensor system and for detecting conductivity differences between the sensor and for signalling the presence of an ice body of a pre-determined size.

The electrodes of the first and second conductivity probes (as indicated by ice input, ice return and by water input, water return in FIG. 2) are electrically connected to a water/ice sensor control 37 by means of leads 39. Likewise, the output of sensor control 37 is connected to the beverage system controller 31 by means of leads 41 such that the sensor control may override controller 31 and block the flow of refrigerant through 13 when the ice bank 30 has attained its maximum predetermined envelope or size.

Referring now to FIG. 2, an electronic circuit constituting sensor control 37 is shown in diagramatic form. As indicated at 43 this circuitry includes means for supplying electric current to the electrodes of the first and second probes 33 and 35, respectively. In this manner, each of the probes is responsive to the electric current supplied thereto so as to measure the conductivity in its vicinity.

Further, the water/ice sensor control 37 includes means 45 for detecting a conductivity difference between the first and second probes 33 and 35, respectively, indicative of the presence of ice in the vicinity of the first probe 33 thereby to signal the presence of ice.

More specifically, the detecting and signally means 45 includes an electrical resistance bridge 47 for comparing the conductivities of the first and second probes, 33 and 35, respectively. This bridge means 49 further includes means for setting a threshold by which the conductivity of the first probe 33 must exceed the conductivity of the second probe 35 before the presence of ice at the first probe is signaled. This threshold means is constituted by the resistor Rl which serves to unbalance the bridge in its quiescent state toward the "no ice" direction. It will be appreciated that the, conductivity of liquid water is significantly different from its conductivity as ice. Thus, when the water in the vicinity of the first probe 33 freezes, the conductivity sensed by the first probe is significantly different from the conductivity sensed when the surrounding vicinity is liquid water. The change in conductivity is more than sufficient to overcome the unbalanced direction of bridge means 47 thereby to positively indicate the presence of ice and to substantially eliminate false signals thereof.

Still further, in water/ice sensor control 37, the bridge means 47 is coupled to a comparator or operational amplifier U2/A such that when the conductivity signal sensed by the first or ice sensor 33 varies a significant amount (i.e., an amount sufficient to overcome the unbalancing of resistor R1), the comparitor generates an output signal. Preferably, a photo transistor U3 is coupled to the output of the operational amplifier for optically isolating the output of the bridge or comparing means. The output (or lack of output) of the photo transistor may then be utilized as a signal transmitted to controller 31 for effecting energization of the modulatable expansion valve 29 thereby to permit the flow of refrigerant through coil 13 which in turn will caus the size of ice bank 30 to increase when the first probe does not sense the presence of ice. However, when the first probe 33 does sense the presence of ice in the vicinity of the first probe, control 37 generates an appropriate signal which is transmitted to controller 31 via leads 41 thereby to override the operation of modulatable expansion valve 2 and thereby to block the flow of refrigerant through ice bank coil 13. Of course, upon the initial melting of ice bank body 30 below a predetermined size, controller 31 and control 37 will work in conjunction with one another to maintain the ice bank 30 at its optimum predetermined size.

While the water/ice sensor control 37 has herein been described as a direct current circuit, such that the probes 33 and 35 are powered by direct current, it would be desirable to power the probes with alternating current of extremely low amperage so as to minimize the effects of galvanic corrosion on the probes.

In view of the above, it will be seen that the several object and features of this invention are achieved and that other advantageous results attained.

As various changes could be made in the above constructions and methods without departing from the scope of the invention, it is intended that all matter contained in the above description or shown in the accompanying drawing shall be interpreted as illustrative and not in a limiting sense.

I claim:

1. An ice sensing system in a beverage dispenser or the like, said beverage dispenser including a cooling tank having a heat transfer liquid therein, a refrigerating surface for cooling said liquid in the cooling tank, and a beverage flowpath in heat transfer relation with the liquid in said tank so that beverage dispensed through the beverage flow path is cooled by said liquid, said liquid in the cooling tank being capable of being frozen into ice by said refrigerating surface, said ice sensing system comprising:

a first conductivity probe disposed in said liquid in said cooling tank at a first predetermined position;

a second conductivity probe disposed in said liquid at a second predetermined position;

the relative positions of said first and second probes with respect to said refrigerating surface being such that said first probe is disposed at a location where said liquid is frozen into ice by said refrigerating surface when the ice attains a predetermined size while said second probe remains a liquid;

means for supplying electric current to said first and second probes, each probe being responsive to the electric current to measure the electrical conductivity in its vicinity, the liquid in he cooling tank being such that its conductivity as a liquid is significantly different from its conductivity as an ice; and means for detecting conductivity differences between said first and second probes indicative of the presence of ice at the first probe and for signalling the presence thereof.

2. The ice sensing system as set forth in claim 1 wherein said detecting and signalling means includes means for comparing the conductivities of said first and second probes, and means for setting a threshold by which the conductivity at said first probe must differ the conductivity at the second probe before the presence of ice at the first probe is signaled.

3. The ice sensing system as set forth in claim 2 wherein said first and second probes are electrically connected in a bridge configuration, said threshold setting means including an unbalanced resistance electrically connected in one arm of the bridge.

4. The ice sensing system as set forth in claim 2 wherein said comparing means has an output which is a function of the relative conductivities of the first and second probes, said detecting and signalling means further including means for optically isolating the output of the comparing means.

5. An ice responsive refrigeration control system for a beverage dispenser or the like, said beverage dispenser including a cooling tank, a cooling liquid in said tank, a refrigerating surface for said cooling liquid in the cooling tank, and a beverage flowpath in contact with the liquid in said tank so that beverage dispensed through the beverage flowpath is cooled by said liquid, said liquid in the cooling tank being capable of being frozen into ice by said refrigerating surface, said ice responsive refrigeration control system comprising:

a first conductivity probe disposed in said liquid at a first predetermined position;

a second conductivity probe disposed in said liquid at a second predetermined position;

the relative positions of said first and second probes with respect to said refrigerating surface being such that liquid at said first probe is likely to be frozen into ice by the refrigerating surface while the liquid at the second probe remains a liquid;

means for supplying electric current to said first and second probes, each probe being responsive to the electric current to measure the electrical conductivity in its vicinity, the liquid in the cooling tank being such that its conductivity as a liquid is significantly different from its conductivity as an ice;

means for detecting conductivity differences between the first and second probes indicative of the presence of ice at the first probe and for signalling the presence thereof; and means responsive to the detecting and signalling means for controlling the flow of refrigerant in the refrigerating surface so as to block the flow of refrigerant to said refrigerating surface upon receipt of a signal indicative of the presence of ice at the first probe and so as to permit the flow of refrigerant to said refrigerating surface upon receipt of a signal indicative of the lack of presence of ice at the first probe.

6. A method of sensing ice in a cold drink dispenser or the like, the dispenser including a cooling tank having a heat transfer liquid therein, a refrigerating surface for cooling said liquid in said cooling tank, and a beverage flowpath in heat transfer relation with the liquid in said tank so that said beverage dispensed through said beverage flowpath is cooled by said liquid, said liquid in said cooling tank being capable of being frozen into ice by aid refrigerating surface, said method comprising the steps of:

positioning a first conductivity probe within said liquid in said cooling tank at a first predetermined position;

positioning a second conductivity probe in said liquid at a second predetermined position, with the relative locations of said first and said second probes with respect to said refrigerating surface being such that said first probe is disposed in conductivity sensing relation with said liquid and/or said ice at a location where the liquid is to be frozen into ice by the refrigerating attains when the ice retains a predetermined size while said second probe remains in conductivity sensing relationship with said liquid;

supplying an electrical current to said first and second probes such that each of said probes is responsive to said electrical current thereby to measure the electrical conductivity in their respective vicinities, the liquid within said cooling tank being such that its conductivity as a liquid as significantly different from its conductivity as an ice;

detecting conductivity differences between said first and said second probes indicative of the presence of ice in the vicinity of said first probe; and signaling the presence of ice in the vicinity of said first probe.

* * * * *